US006629601B1

(12) United States Patent
Russell

(10) Patent No.: US 6,629,601 B1
(45) Date of Patent: Oct. 7, 2003

(54) MULTI-FUNCTION TRAVEL GOLF BAG

(76) Inventor: Marsha A. Russell, 141-R North St., Salem, MA (US) 01970

( * ) Notice: Subject to any disclaimer, the term of this patent is extended or adjusted under 35 U.S.C. 154(b) by 0 days.

(21) Appl. No.: 09/683,826

(22) Filed: Feb. 20, 2002

(51) Int. Cl.[7] ..... A63B 55/00

(52) U.S. Cl. ..... 206/315.3; 206/315.5; 206/315.6

(58) Field of Search ..... 206/315.3, 315.5, 206/315.6; 150/159

(56) References Cited

U.S. PATENT DOCUMENTS 1,437,349 A * 11/1922 Moore, Jr. ..... 206/315.4 X
1,442,906 A * 1/1923 Rawlings et al. ..... 206/315.6
1,597,870 A * 8/1926 Reach ..... 206/315.6
3,985,171 A * 10/1976 Summers et al. ..... 150/159
4,227,559 A * 10/1980 Stroman ..... 206/315.6 X
4,249,586 A * 2/1981 Setani ..... 206/315.3
4,334,564 A * 6/1982 Clayton ..... 206/315.6
4,420,024 A * 12/1983 Clayton ..... 206/315.6 X
4,664,382 A * 5/1987 Palmer et al. ..... 206/315.6 X
4,793,532 A 12/1988 Cash
5,176,253 A * 1/1993 Perrin et al. ..... 206/315.5
5,860,519 A * 1/1999 Meyer et al. ..... 206/315.3
5,967,324 A * 10/1999 Izzo ..... 206/315.4 X
6,234,307 B1 * 5/2001 Beck ..... 206/315.9
6,286,673 B1 9/2001 Robertson

* cited by examiner

*Primary Examiner*—Tri M. Mai
(74) *Attorney, Agent, or Firm*—Mark P. White

(57) ABSTRACT

A multi-configuration golf bag may be used to carry golf clubs while playing golf, or may be used to transport the clubs to and from the golf course in a flat configuration or in a rolled up, compressed configuration. The golf bag has a body formed from a sheet of robust material, such as leather or composite foam with a heat-bonded synthetic surface. Pockets are attached to the inner surface of the body to separate the clubs from each other when the golf bag is in playing configuration. When rolled up in compressed configuration, the body is wrapped tightly about the clubs, securing them within a smaller cylindrical shape. The bag may also be transported in planar configuration, with the golf clubs retained within a hood attached to the top of the body.

9 Claims, 7 Drawing Sheets

MULTI-FUNCTION TRAVEL GOLF BAG

BACKGROUND OF INVENTION

The game of golf is one of the most popular pastimes of the American public, and has been for some time. It is popular in many other parts of the world as well, and may, in fact, be the most popular sport in the world, being played with substantially the same rules everywhere.

The game requires for its use a large number of clubs, with an absolute maximum, of nine irons, four woods, and a putter. Players usually use their own clubs, in accordance with the rules of the Professional Golf Association. These are generally personally selected in accordance with the golfer's individual preferences, and the clubs are kept in specially designed golf bags, in which the clubs are stored and transported.

These golf bags are generally sufficiently large that there is insufficient space in a typical American sedan for a foursome" (four players) to travel to a golf course with their four golf bags. The golf bags are simply too large for four of them to fit in the trunk, or boot, and there is insufficient space in the passenger compartment for the players and the golf bags.

In addition, some vehicles, such as two-seated sports cars, do no have space sufficient for two passengers and two golf bags. This is especially true of some sports cars, such as the Mercedes-Benz Model SLK-320, which takes up most of the available space in the trunk (boot) with a removeably hard top.

The present invention solves this problem by means of a reconfigurable golf bag, which may be transported in the form of a traditional golf bag, as a substantially flat sheet, containing the clubs, or in a cylindrical shape, similar to the traditional form, but having a drastically reduced diameter, permitting several golf bags to be stacked in the space formerly required for a single bag.

The prior art discloses several similar inventions. U.S. Pat. No. 6,286,673 describes a golf bag which is made up of a number of rigid tubes, disposed along a flat sheet, which may be rolled up into a cylindrical form and retained in that position. However, U.S. Pat. No. 6,286,673 does not provide for configuring the bag in a reduced diameter form, nor does it provide the insulated hood for protecting the club heads while transporting them. Furthermore, U.S. Pat. No. 6,286,673 requires the tubes from which the carrier is constructed to be at least semirigid, lest the structure collapse when rolled up, rather than remaining in the cylindrical shape as shown.

The present invention uses a semi-rigid material as the body of the bag, thus providing support for the structure from the outside, rather than relying on the internal tubes of the prior art for structural support. Furthermore, the present invention allows the bag to be rolled up into the shape of a cylinder with a reduced diameter, snugly enclosing the clubs so that they cannot slide out of the bag, and thereby preventing them from clashing against the other clubs, protecting them during transportation in this manner.

SUMMARY OF INVENTION

It is an object of the present invention to provide a multi-function golf bag which can be used both for holding the golfer's clubs while playing golf, and for transporting the clubs to and from the golf course. It is a further object of the invention to provide such a golf bag having one or more reduced-size configurations which allow the transportation and storage in places of limited storage space.

In accordance with one aspect of the invention, the golf bag includes a body made of a sheet of firm, compliant material having an inner surface and an outer surface, a top, a bottom, a first edge, and a second edge. Fasteners are used for attaching the inner surface to the outer surface at two or more places, and the body is rolled into a cylinder, with the fasteners used to maintain the body in said cylindrical shape. The body may be alternatively rolled into a second cylindrical shape, having a second diameter, smaller than the first, which securely retains the clubs within when wrapped in this fashion.

In accordance with a second aspect of the invention, the fasteners are hook and loop fasteners.

In accordance with a third aspect of the invention, a multiplicity of golf club pockets is attached to the inner surface of the body and one or more golf clubs are placed within each golf club pocket,In accordance with a fourth aspect of the invention, a flexible golf-bag bottom is removeably attachable to the body.

In accordance with a fifth aspect of the invention, a flexible ball tube is included, disposed in parallel to the golf club pockets, into which golf balls may be inserted and removed.

In accordance with a sixth aspect of the invention, a removable hood is included, made of a sheet of flexible material having a top, a bottom, and two sides. The top of the hood is attached to the top of the body in one region of the body, the bottom of the hood is attached to the top of the body in a second region of the body.

In accordance with a seventh aspect of the invention, a club-head protector located approximately midway between the hood top and hood bottom, so that when the hood affixed to the body when the body is in a substantially flat configuration, the club-head protector will align and at least partially surround the golf club heads.

BRIEF DESCRIPTION OF DRAWINGS

These, and further features of the invention, may be better understood with reference to the accompanying specification and drawings depicting the preferred embodiment, in which.

DETAILED DESCRIPTION

The present invention is an adjustable-size golf bag which may be reconfigured for use in a number of different situations. The bag is adaptable both for transporting the clubs, and for use for carrying the clubs and other equipment while playing golf.

The bag has several different configurations: the playing configuration, whereby the bag has the general size and shape of a standard golf bag, the flat configuration, and in a compressed configuration.

In this last-described compressed configuration the bag is substantially cylindrical, but is wrapped tightly about the clubs, presenting a substantially reduced diameter as compared to the diameter while in the playing configuration. The reduced diameter configuration makes the bag practical as a container for transporting the clubs within, as the clubs are tightly contained by the pressure of the bag. As a result, they are prevented from falling out of the bag in this reduced-diameter configuration, and the club heads are protected from colliding with each other due to the friction between the club shafts and the inside of the bag. Furthermore, the reduced diameter configuration allows the bag to be transported under circumstances where it will not fit in the space available for transportation in any other configuration.

In a third configuration the bag may be opened into a substantially flat sheet, with the clubs attached to the inside surface of the bag by pockets, and the clubs retained by means of a hoot attached to the upper edge of the body.

Figure 4A:
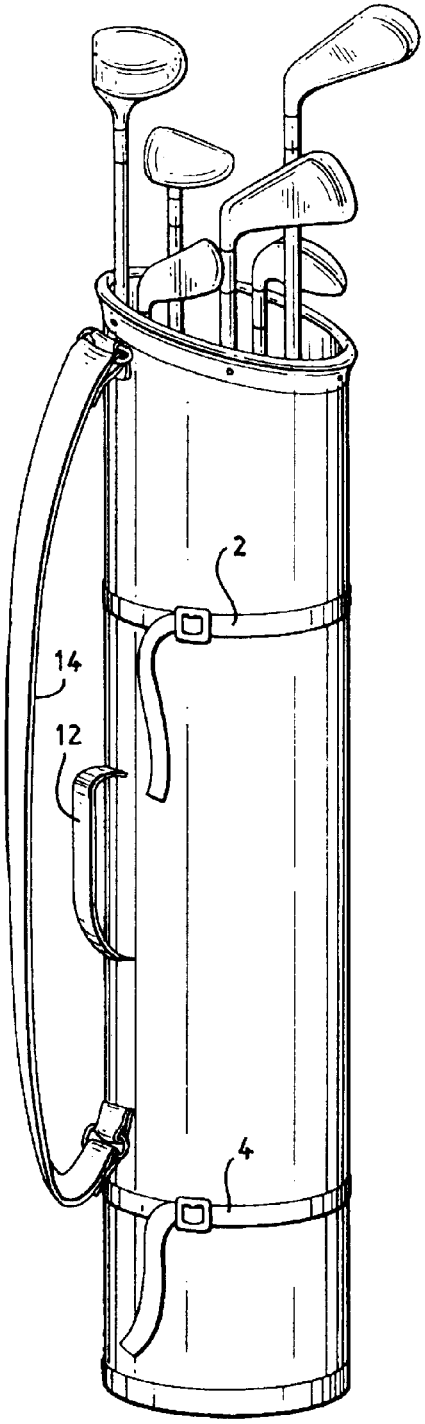
FIG. 4A depicts the golf bag in its cylindrical, compressed configuration, without golf club pockets.
Figure 4B:
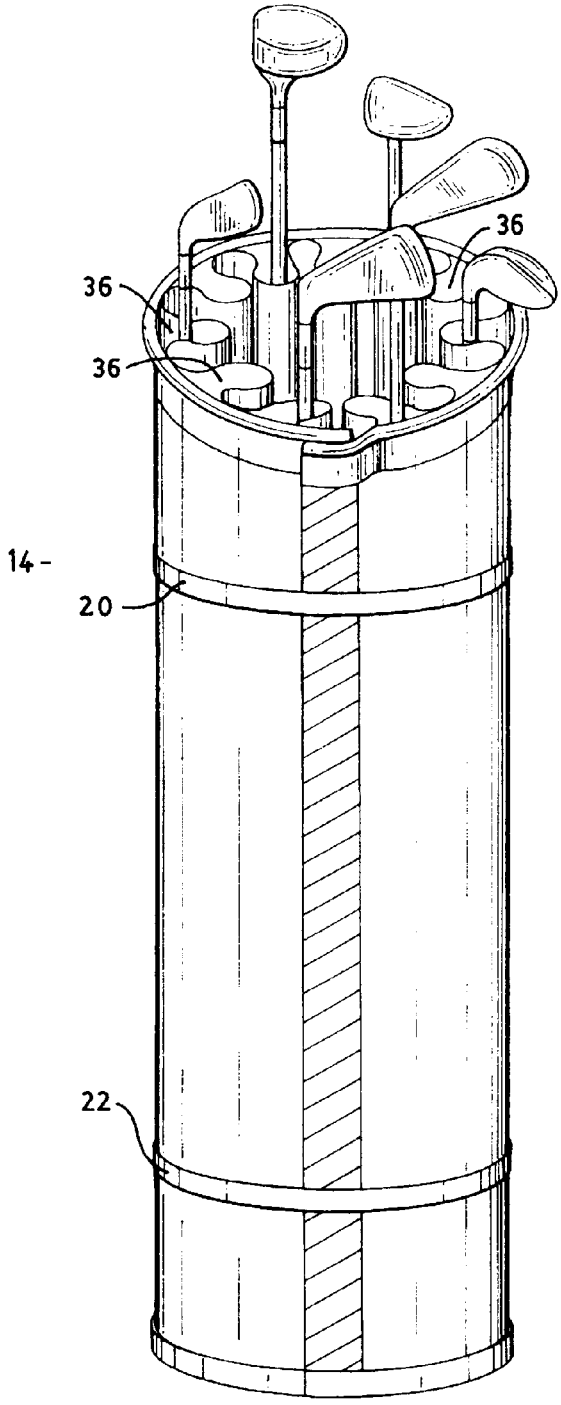
FIG. 4B depicts the golf bag in its playing configuration, with golf-club pockets.

These basic configurations may be seen in FIG. 4*b,* which depicts the bag in playing configuration; FIG. 4A, depicting the compressed configuration, and FIG. 5, in which the configuration is planar, with the golf clubs restrained by a hood 44. This hood may also be left attached in the configurations shown in FIGS. 4A and 4B as well. FIG. 6A depicts the bag in playing configuration with the hood attached.

Figure 2:
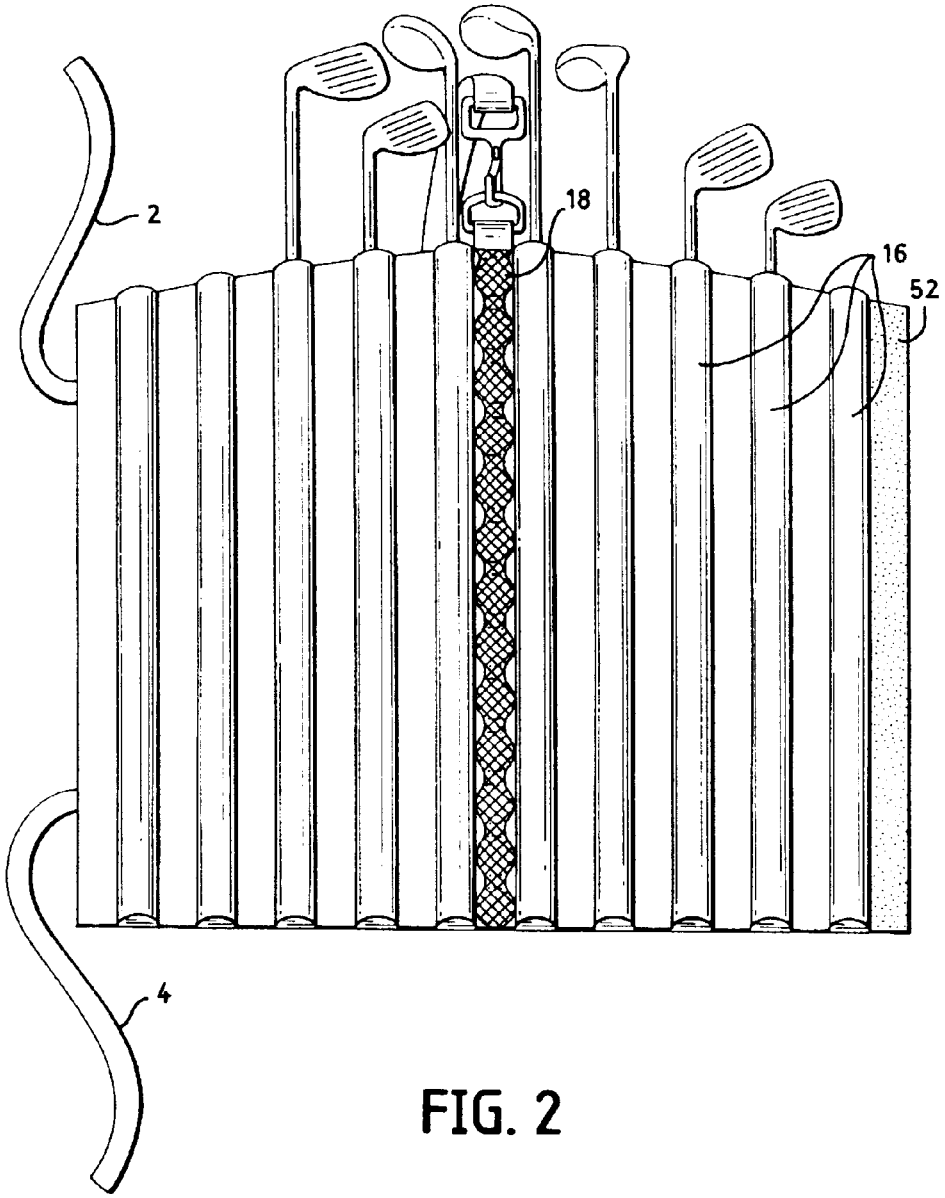
FIG. 2 depicts the golf bag in its flattened configuration, showing the hook and loop strip providing for the cylindrical configuration.
Figure 3:
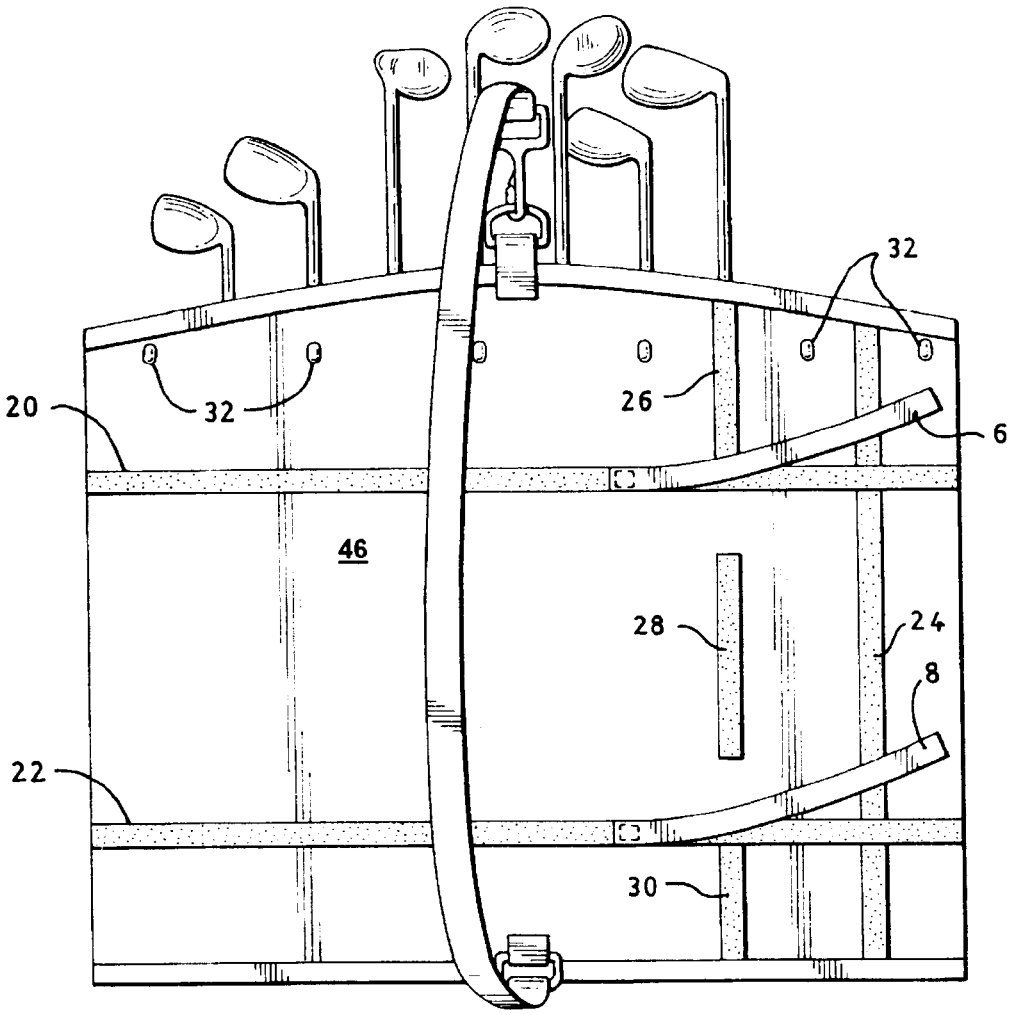
FIG. 3 depicts the golf bag in its flattened configuration, with outer surface shown.

The invention may be understood in detail by first referring to FIGS. 2 and 3. The body of the golf bag is constructed from a sheet of flexible, reinforced material. The material must be flexible enough to allow it to bend into the desired, substantially cylindrical shape. It must also be sufficiently robust, and compliant, to retain the desired shape while the user is playing. In short, the bag, in playing configuration, should look very much like the golf bags golfers are used to, as currently exist in the prior art.

Leather, including artificial leather, is one of the favorite materials for golf bags, and is suitable for use in the present invention, providing that the leather is heavy and stiff enough to sustain the desired shape in the playing configuration. Otherwise, reinforcement is required sufficient to sustain this shape. However, it is noted that the shape of the bag is maintained entirely by the sheet of material making up the body, and not by any extrinsic structure.

Of particular utility in the present invention is a high-density, foam composite used for the body of the current golf bag. Examples of foams suitable for this application include EVA (ethyl vinyl acetate). In the preferred embodiment, this composite material forms the core of the golf bag body. An outer fabric is then bonded onto the outer surface of the composite foam core. The outer fabric should be attractive, but wear resistant. Leather, vinyl, nylon, and similar materials may be used for the external, or outer surface of the bag. Bonding methods appropriate for this type of construction incude flame bonding, and cement bonding, both of which are well known in the art.

The inner surface of the bag is likewise bonded to a fabric, typically the same fabric used for the outer surface, and bonded by the same bonding method as with the outer surface. This technique produces a highly durable, firm, but compliant composite body, so that the bag, when formed into a cylindrical shape, will not collapse, but retains the form of a traditional golf bag. This composite structure produces a golf bag which is more rugged, and wear resistant than the typical golf bag of the prior art.

In the preferred embodiment, pockets are attached to the outer surface of the golf bag, similar to what is typical of prior art golf bags. These outer pockets are used for sundry items, such as golf balls, aspirin, band aids, cosmetics, etc.

Referring now to FIG. 2, the clubs are retained within the bag by a number of individual pockets 16, spaced from each other. There is a separate pocket for each golf club. These pockets are generally of cloth or synthetic material, and do not provide any structural strength to support the bag, but are used only to separate the clubs, and to keep the club-heads from clashing, and damaging each other. The pockets may run the entire length of the body, and have closed ends to retain the club shafts, keeping them from falling through the bottom of the pockets. Or, in the embodiment in which a bottom is provided for the bag, the pockets may be quite short, comprising only loops to retain the clubs in the vicinity of the club heads, and having a length of an inch or less.

Figure 7:
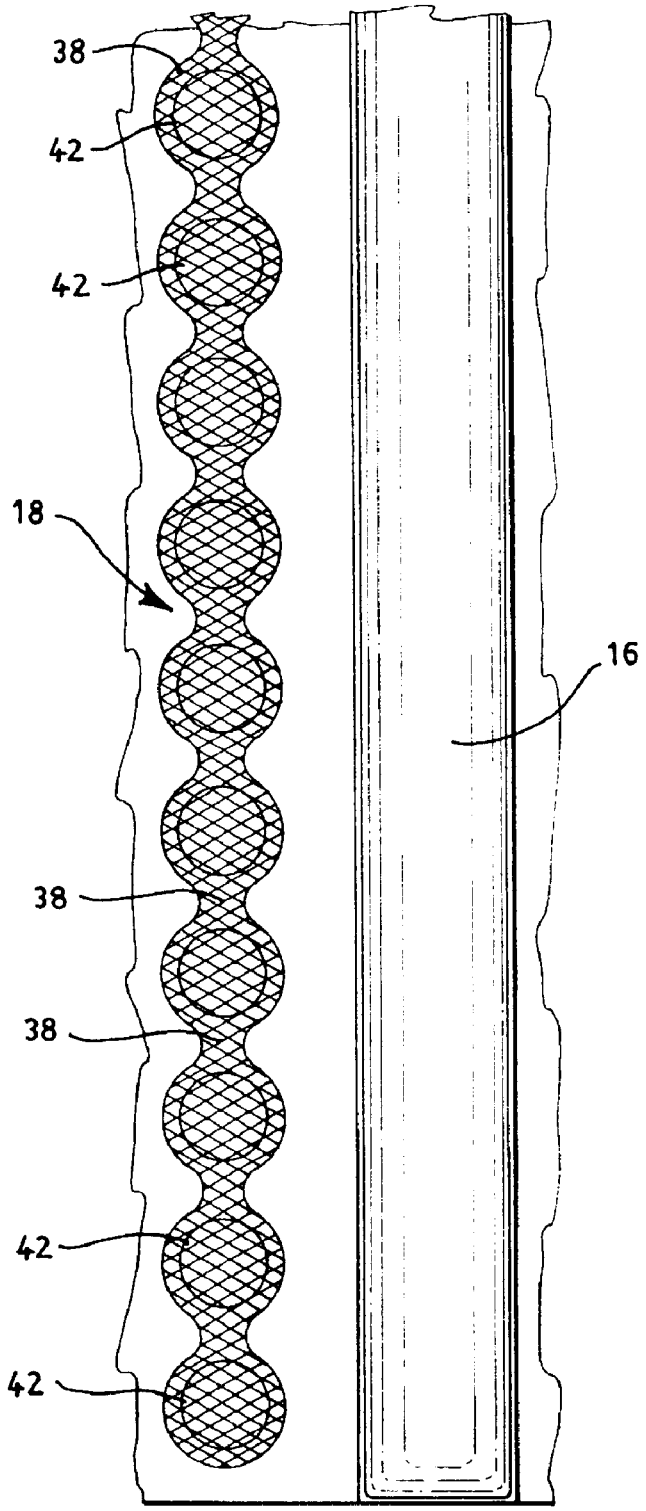
FIG. 7 depicts a detailed view of the golf-ball tube affixed alongside a golf-club pocket.

Still referring to FIG. 2, a flexible golf ball tube is provided, and is attached to the center of the inner surface of the body. The golf ball tube is shown in more detail in FIG. 7. It is made of an elastic netting 38, in which the golf balls 42 are held. The user brings the balls to the top of the bag by squeezing the tube. As seen in FIG. 7, the golf ball pocket is approximately the same size as, and parallel to the golf club pockets. However, the golf club tube is affixed to the body of the bag only at the top of the tube, so the user may more easily access the golf balls by lifting the bottom of the golf club tube out of the bag, when in playing configuration.

Referring again to FIGS. 2 and 3, the method of rolling the bag up may be understood. In the embodiment shown the outer surface contains Velcro® strips 24 near the left-most edge of the body and parallel to the edge. This strip mates with a Velcro® strip 52 of complementary material type when the bag is rolled up into a cylinder, as seen in FIG. 4B, which shows the overlap between the inner and outer strips at the seam where the two join at the front of the bag.

Referring again to FIG. 3, the outside of the body contains a second set of strips 26, 28, and 30, which are parallel to strip 24, and of the same Velcro® type as strip 24. It is evident that when the bag is rolled to a position where strip 52 is aligned with strips 26, 28, and 30, the diameter of the resulting bag will be substantially less, resulting in a more compact shape, as shown in FIG. 4A. This shape is called the "compressed configuration", and is used to transport the clubs to and from the golf course, or for storage.

FIG. 3 further shows fastening strips 20, 22 parallel to the bottom of the body. These may,also be either Velcro®, or belt and buckle type fasteners. Their use is shown in FIG. 4B. When the bag is in one of its rolled up configurations, it may be further secured by attaching complementary Velcro® straps 6, 1 to the horizontal strips 20, 22, as shown in FIG. 4B, thus encircling the bag at two levels, and preventing the vertical seams from coming apart. FIG. 4B shows the use of Velcro® fasteners for this purpose. However, other types of fasteners may be used for securing the horizontal restraints, including simple belt 2, 4 and buckle arrangements, as shown in FIG. 4A.

Figure 1:
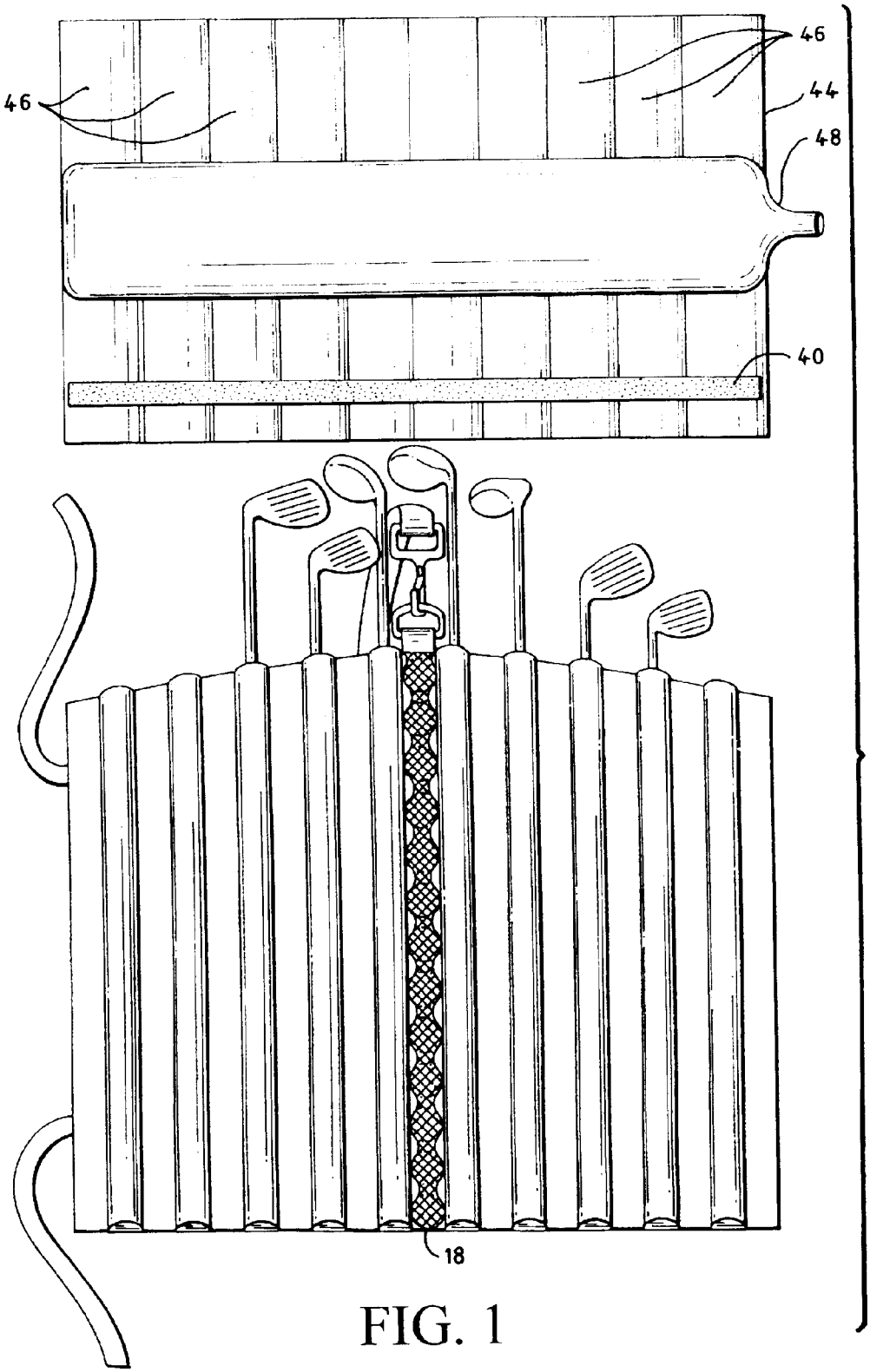
FIG. 1 depicts the golf bag in its flattened configuration, with inner surface shown, and with the hood separated from the body.
Figure 5:
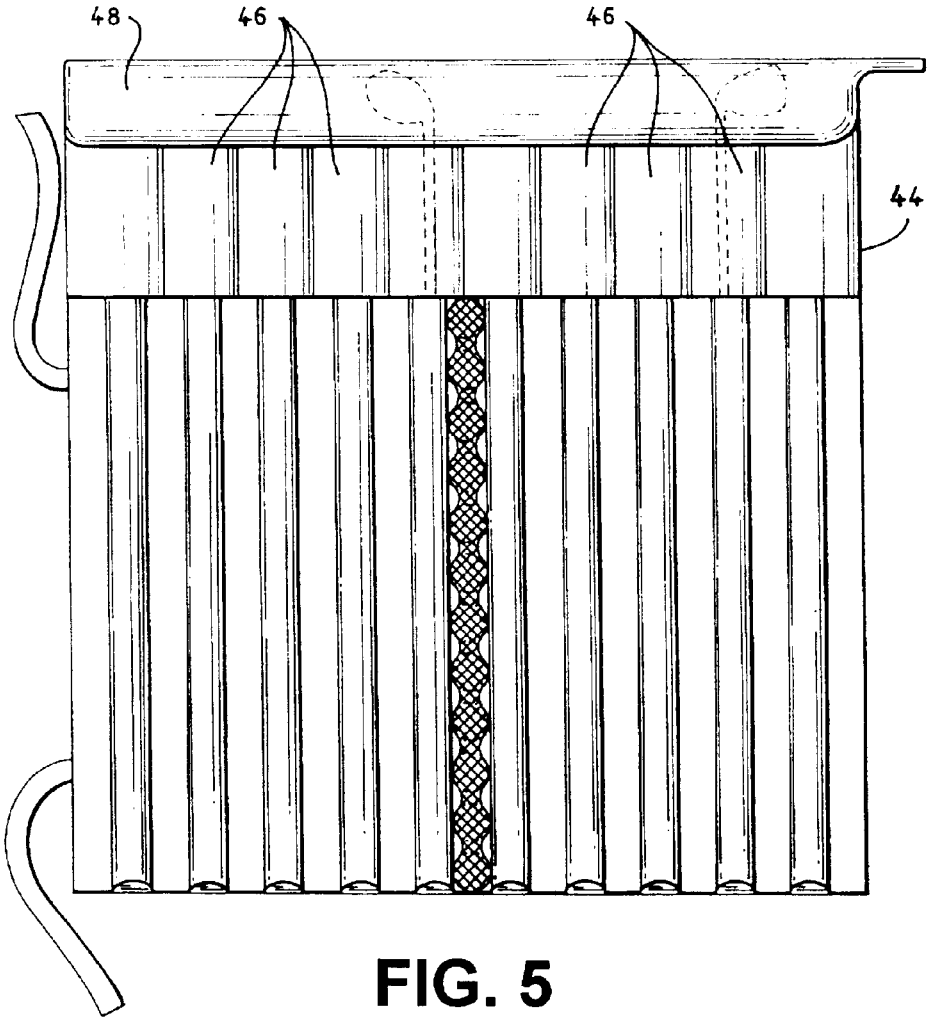
FIG. 5 depicts the golf bag in its flattened configuration, with inner surface shown, and with the hood affixed to the body.
Figure 6:
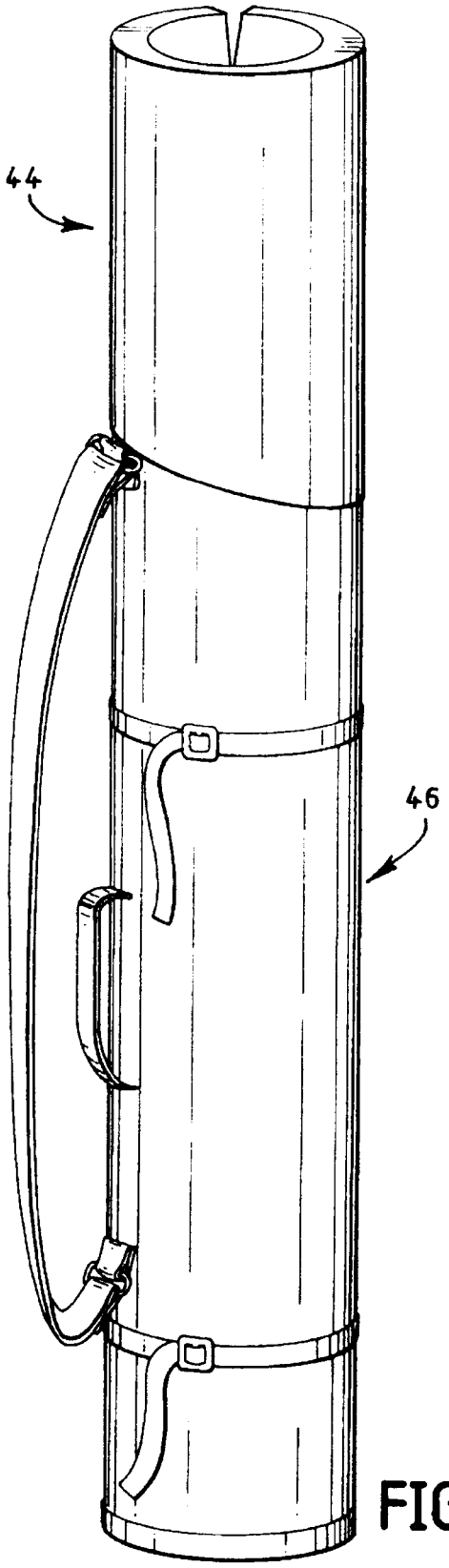
FIG. 6 depicts the golf bag in its playing configuration, with the hood affixed to the body.

Referring now to FIGS. 1 and 5, a hood is provided to protect the golf club heads in one of the alternative embodiments. When the bag is transported in a planar, or flattened configuration, the hood is essential to prevent the clubs from slipping out of the bag. As seen in FIG. 1, the hood 44 is a substantially rectangular sheet of material which may be cloth, synthetic fabric, or other light, flexible material. It provides no substantial structural strength. However, means are provided to protect the club heads. In the embodiment shown in the figure, an inflatable bladder 48 is provided. The club heads are inserted into hood pockets 46 provided in the hood, and the club heads are inserted to about the middle of the hood, which is then folded over. The hood may be attached to the body by any number of means, including mating Velcro strips 40, as shown in FIG. 1, or snaps 32, as shown at the upper part of the body in FIG. 3. Once the hood is thus affixed to the body, the bladder 48 is blown up, and stopped by closing off the air entrance by any number of means, including clamps.

Thus, when the hood is in place, as shown in FIG. 1, the heads of the clubs are securely captured within the hood by the pressure of the bladder, and the clubs are thus prevented from coming loose from the golf bag. The hood may be left in place when the bag is rolled up as well, as shown in FIG. 6A. When the bag is rolled up with the hood attached, some or all of the air is allowed to escape from the bladder which allows the bladder to bend into the circular shape shown.

In other configurations the bladder is replaced by a strip of foam material, and the clubs further restrained by attaching to the hood in the vicinity of the heads.

In an alternative embodiment the golf club pockets are not provided. Rather, a flexible golf bag bottom encloses the bottom of the bag when in its playing configuration. The golf bag bottom may be made any kind of strong, flexible material, an it may be attached by any number of well known means, available in the prior art, and including Velcro®, snaps, belts, zippers, etc.

While the invention has been described with reference to specific embodiments, it will be apparent that improvements and modifications may be made within the purview of the invention without departing from the scope of the invention defined in the appended claims.

What is claimed is:

1. A hood for use with a multi-configuration golf bag comprising a sheet of firm, compliant material having an inner surface and a multiplicity of golf-club pockets disposed along the inner surface, the bag being rollable into a first cylindrical shape having a first diameter and a second cylindrical shape having a second diameter smaller than the first, and fastening means to retain the bag in one of the cylindrical shapes, the hood comprising:

(a) a substantially rectangular sheet of flexible material having two longer sides and two shorter sides, mateable along the longer sides with the golf bag in proximity to a top edge of said golf bag;

(b) an inflatable bladder, disposed substantially parallel to the longer sides of the sheet of material and substantially midway between said longer sides and attached thereto; and (c) fastening means to removeably attach the longer sides of the hood to the golf bag in proximity to the top edge when the hood is folded along a line substantially parallel to the longer sides so that the bladder is folded in two, so that when golf clubs are placed in the bag, and the bladder inflated, the bladder is in contact with heads of the golf clubs, protecting them from damage.

2. The hood of claim 1, wherein the fastening means further comprises a multiplicity of fasteners selected from the group which consists of:

(a) hook and loop fasteners; and (b) snap fasteners.

3. A multi-configuration golf bag comprising:

(a) a sheet of firm, compliant material having an inner surface and an outer surface;

(b) a multiplicity of golf-club pockets disposed along the inner surface;

(c) a hood, further comprising:

(i) a substantially rectangular sheet of flexible material having two longer sides and two shorter sides, mateable along the longer sides with the golf bag in proximity to a top edge of said golf bag;

(ii) an inflatable bladder, disposed substantially parallel to the longer sides of the sheet of material and substantially midway between said longer sides and attached thereto; and (iii) fastening means to removeably attach the longer sides of the hood to the golf bag in proximity to the top edge when the hood is folded along a line substantially parallel to the longer sides so that the bladder is folded in two, so that when golf clubs are placed in the bag, and the bladder inflated, the bladder is in contact with heads of the golf clubs, protecting them from damage.

4. The hood of claim 3, wherein the fastening means further comprises a multiplicity of fasteners selected from the group which consists of hook and loop fasteners; and snap fasteners.

5. The multi-configuration golf bag of claim 4, wherein the hook and loop fasteners further comprise one or more first strips and one or more second strips, wherein:

a) one or more of the first strips are affixed to the inner surface of the sheet, and disposed in proximity with a first side of the sheet, comprising a first set;

b) one or more of the second strips are affixed to the outer surface of the sheet, and disposed in proximity with a second side of the sheet, comprising a second set; and c) one or more of the second strips are affixed to the outer surface of the sheet, substantially parallel to the second set, but displaced from the first set toward the center of the sheet, comprising a third set, so that when the strips of the first set are affixed to those of the second set the golf bag has a larger diameter, and when the strips of the first set are affixed to those of the third set the golf bag has a second diameter.

6. The multi-configuration golf bag of claim 5, wherein the sheet is comprised of a material chosen from the group which consists of:

leather;

vinyl;

composite foam bonded to a fabric on the outer surface; and composite foam bonded to a fabric on the outer and inner surfaces.

7. The multi-configuration golf bag of claim 6, further comprising a flexible ball tube, disposed in parallel to the golf club pockets, into which golf balls may be inserted and removed.

8. The multi-configuration golf bag of claim 7, wherein the flexible ball tube comprises elastic netting.

9. The multi-configuration golf bag of claim 3, further comprising two or more straps, disposed circumferentially about the golf bag.

* * * * *